US008933814B2

(12) United States Patent
Berg et al.

(10) Patent No.: US 8,933,814 B2
(45) Date of Patent: Jan. 13, 2015

(54) LED LIGHT SIGNAL

(75) Inventors: Eike Berg, Berlin (DE); Rolf Eckl, Berlin (DE); Norbert Poepplow, Eichwalde (DE)

(73) Assignee: Siemens Aktiengesellschaft, Munich (DE)

( * ) Notice: Subject to any disclaimer, the term of this patent is extended or adjusted under 35 U.S.C. 154(b) by 97 days.

(21) Appl. No.: 13/807,786

(22) PCT Filed: Jun. 9, 2011

(86) PCT No.: PCT/EP2011/059585

§ 371 (c)(1), (2), (4) Date: Dec. 31, 2012

(87) PCT Pub. No.: WO2012/000762

PCT Pub. Date: Jan. 5, 2012

(65) Prior Publication Data

US 2013/0099933 A1 Apr. 25, 2013

(30) Foreign Application Priority Data

Jun. 29, 2010 (DE) ..... 10 2010 026 012

(51) Int. Cl.

| | |
|---|---|
| ***G08B 5/22*** | (2006.01) |
| ***G08B 5/36*** | (2006.01) |
| ***B61L 5/18*** | (2006.01) |
| ***H05B 33/08*** | (2006.01) |

(52) U.S. Cl.

CPC ..... *G08B 5/36* (2013.01); *B61L 5/1827* (2013.01); *B61L 5/1881* (2013.01); *H05B 33/0869* (2013.01); *B61L 2207/02* (2013.01)

USPC ..... 340/815.45; 340/815.4

(58) Field of Classification Search

USPC ..... 340/815.45

See application file for complete search history.

(56) References Cited

U.S. PATENT DOCUMENTS

| | | | | |
|---|---|---|---|---|
| 6,707,435 | B1 | 3/2004 | Merlato et al. | |
| 7,378,983 | B2 * | 5/2008 | Wang et al. | 340/815.45 |
| 2004/0105264 | A1 * | 6/2004 | Spero | 362/276 |
| 2005/0099319 | A1 | 5/2005 | Hutchison et al. | |
| 2008/0303659 | A1 * | 12/2008 | Weiss | 340/540 |
| 2009/0140656 | A1 * | 6/2009 | Kohashikawa et al. | 315/151 |
| 2010/0013811 | A1 * | 1/2010 | Ahn et al. | 345/207 |

FOREIGN PATENT DOCUMENTS

| | | | |
|---|---|---|---|
| DE | 20220900 | U1 | 5/2004 |
| DE | 102010012800 | A1 | 9/2011 |
| EP | 0935145 | A1 | 8/1999 |
| EP | 0979597 | B1 | 7/2002 |
| EP | 2131628 | A2 | 12/2009 |
| GB | 2446410 | A | 8/2008 |
| WO | 2011113794 | A1 | 9/2011 |

* cited by examiner

*Primary Examiner* — Kerri McNally

(74) *Attorney, Agent, or Firm* — Laurence A. Greenberg; Werner H. Stemer; Ralph E. Locher

(57) ABSTRACT

An LED light signal, in particular an LED railway light signal, contains a signal generator for generating varicolored light spots. The LEDs are embodied as multicolor LEDs, in particular RGB LEDs—Red/Yellow/Blue LEDs. In order to be able to utilize the possibilities for color mixing and thus for realizing a large number of color variants for safety-relevant signaling technology, the signal generator has at least one optical sensor for monitoring a color locus and a light intensity reliably in terms of signaling technology.

6 Claims, 4 Drawing Sheets

LED LIGHT SIGNAL

BACKGROUND OF THE INVENTION

Field of the Invention

The following explanations relate substantially to luminous symbols or light signals for the display of signal aspects in rail-bound traffic routes, without the claimed inventive subject matter being intended to be restricted to this use.

Light signals or luminous symbols based on LEDs—light-emitting Diodes—instead of incandescent lamps are increasingly being used in many areas, in particular in railway signaling technology. LEDs are comparatively inexpensive, long-lasting and exhibit high light intensity. The trend is in the direction of HLEDs—high-power LEDs—, the light intensity of which is so high that even a single HLED per light spot emits sufficient light to achieve the required brightness.

In the LED matrices having a plurality of LEDs that have previously been common, the serviceability thereof is monitored via a current measurement. This ensures that, even in the event of a few defective or failed LEDs, a minimum brightness is maintained over a specific time period. In the case of HLEDs, on the other hand, failure thereof suddenly leads to an extreme loss of brightness, so that the conventional monitoring concept by means of current measurement no longer satisfies the safety requirements, in particular in the case of safety levels SIL3 and SIL4.

The safety levels are defined in the Cenelec Standard EN50129 from SIL0—not fail-safe—to SIL4—extremely fail-safe.

In order to check the serviceability of the LEDs, in particular the HLEDs, the light intensity of the signal is therefore increasingly being measured instead of or in addition to the energization. The measured actual light intensity can then be used as a guide variable to control the light intensity to a predefined desired value.

In the case of light signals having variously colored light spots, actual current monitoring can additionally be provided for each light spot. In order to be able to operate the light signal to safety level SIL3 or SIL4, it must be ensured that only the light spot having the envisaged color is energized and that no current flows through the further light spots.

A further trend in LED technology is to combine LEDs of different colors in a compact structural unit. For example, RGB LEDs are known—red/yellow/blue LEDs—in which three LEDs having the colors red, yellow and blue are integrated in one LED housing. In the case of these RGB LEDs, because of the design, it is impossible or possible only with difficulty to determine on the basis of a current measurement through which of the three LEDs the current is flowing. However, this is necessary in order to reach SIL3 or SIL4.

With RGB LEDs, it is possible to realize a plurality of colors in a light spot. In this case, however, LEDs of the same color are always energized, so that the number of colors that can be displayed and also the number of variously colored LEDs is limited. In principle, however, by using RGB LEDs, a multiplicity of colors, i.e. color loci, can be achieved in that variously colored LEDs are simultaneously energized or activated by means of PWM—pulse width modulation—which results in mixed colors. This technology is already used for illumination and display purposes. However, adaptation to signal generators is problematic since, because of the safety-relevant significance of the light signals, in particular in railway operation, reliable signal monitoring both of the light intensity and the color locus in signaling terms is required.

BRIEF SUMMARY OF THE INVENTION

The invention is based on the object of specifying a multi-color LED light signal which meets high safety requirements, the intention also being for mixed colors to be capable of reliable implementation in signaling terms.

According to the invention, the object is achieved in that the signal generator has at least one optical sensor for monitoring the color locus and the light intensity reliably in terms of signaling technology.

Only by means of the reliable measurement of the optical parameters is it possible to use RGB LEDs for light signals having very high safety requirements, in particular SIL3 or SIL4. It is possible to dispense with color-specific current measurements, which are not possible at all or only with great difficulty in the case of RGB LEDs. On account of the trend to LEDs with higher light intensity and, at the same time, to reducing manufacturing costs, it is possible to use a single RGB LED instead of at least three individual HLEDs of different colors. In addition, the colors can be mixed reliably in terms of signaling technology.

The reliable monitoring is based on the separation of the activation to generate the required color locus and the reliable optical monitoring of the light actually emitted. The result is a two-channel reliable system, wherein the activation can usually be carried out in a non-safety-relevant manner, although the entire system can be classified as reliable in signaling terms in the sense of SIL3 or SIL4 as a result of the reliable monitoring in signaling terms of the expected function.

At least two independent optical sensors are preferably provided. This ensures that changes in one measuring channel can be disclosed. The fault detection can additionally be assisted by a method which raises and lowers the intended brightness slightly in the tolerable range. If the actual brightness measured in the at least two channels follows the intended brightness as expected, it is possible to assume a fault-free system. The same principle can also be applied, alternatively or additionally, by varying the color locus, by which means still higher requirements on the safety can be implemented.

Accordingly, provision is made for the optical sensor to have a plurality of color-specific individual sensors. The color-specific individual sensor then registers only a brightness of the signal or light intensity when the light spot having the associated color is activated. Defects of any type are easily detected, since then either none of the color-specific individual sensors or an individual sensor which is not assigned to the desired color generates an output signal.

The color-specific individual sensor can be implemented, for example, by means of upstream color filters. In this way, a brightness sensor can be used which is designed for the entire color range, i.e. for the entire visible light spectrum. The color filter upstream of the individual sensor has the effect that the individual sensor reacts only to a specific color.

However, the optical sensor can also be designed as a wide-spectrum sensor. In this case, the output signal from the optical sensor must be evaluated with regard to the spectral composition whilst taking the spectral sensitivity of the sensor into account.

Preferably, the sensor is connected via a sensor amplifier and an ND converter to a digital evaluation device, in particular a controller, in order to determine the actual color locus and the actual light intensity. The optical sensor measures the emitted light. The sensor amplifier is used to amplify and calibrate the output signal from the optical sensor. By means of the calibration, physical characteristics, for example the sensitivity of the sensor or the input range of the evaluation device, can be compensated.

By means of the sensitivity compensation, the output signals from the optical sensor can be standardized in such a way that conclusions about the color components are possible directly from the output signals. The compensation values follow from the characteristics of the sensor. The environmental response, in particular the temperature response, of the sensor is preferably also taken into account during the generation of the compensation signal.

However, the compensation can also be moved from the sensor amplifier to the evaluation device. In this case, a sensitivity profile is stored in the controller. The sensor amplifier can be simplified as a result. However, as a result of the necessary higher dynamics of the input values, the demands on the ND converter connected upstream of the controller rise. By means of suitable selection of the evaluation method, both narrow-band sensors and broadband sensors can advantageously be used.

Accordingly, provision is made for the evaluation device to generate a feedback signal dependent on environmental conditions, in particular the ambient temperature, and to forward said signal to a signal box, wherein the signal box generates an activation signal to be applied to the signal generator, and means for comparing the feedback signal with the activation signal are provided. By means of suitable linking with external influences, for example temperature or ambient light, physical characteristics of structural elements, e.g. the temperature response thereof, or of the location of use, for example with regard to the ambient light conditions, can be compensated, so that a feedback signal which is directly comparable with the activation signal to be applied to the signal generator is reported to the signal box. In the signal box, reliable information about the proper function of the LED light signal is thus present at every time.

The evaluation device additionally has means for comparing the actual color locus and/or the actual light intensity with an intended color locus and/or an intended light intensity, wherein deviations which exceed a threshold value trigger an inherently safe reaction. The feedback to the signal box can be provided on the basis of the monitoring or of the intrinsically safe reaction.

The evaluation device uses the activation signal for the signal generator and the spectral sensitivity of the optical sensor to calculate an expected sensor signal. This intended sensor signal is compared with the actual sensor signal measured. The deviation is evaluated, an intrinsically safe reaction, for example switching off safely in signaling terms, being carried out if appropriate. In the event of a fault, the evaluation device ensures that energization is carried out on the fail-safe principle, which means that, in the case of a light signal for the signal aspect display, the red stop signal illuminates.

The invention will be explained in more detail below by using pictorial representations, in which:

DESCRIPTION OF THE INVENTION

Figure 1:
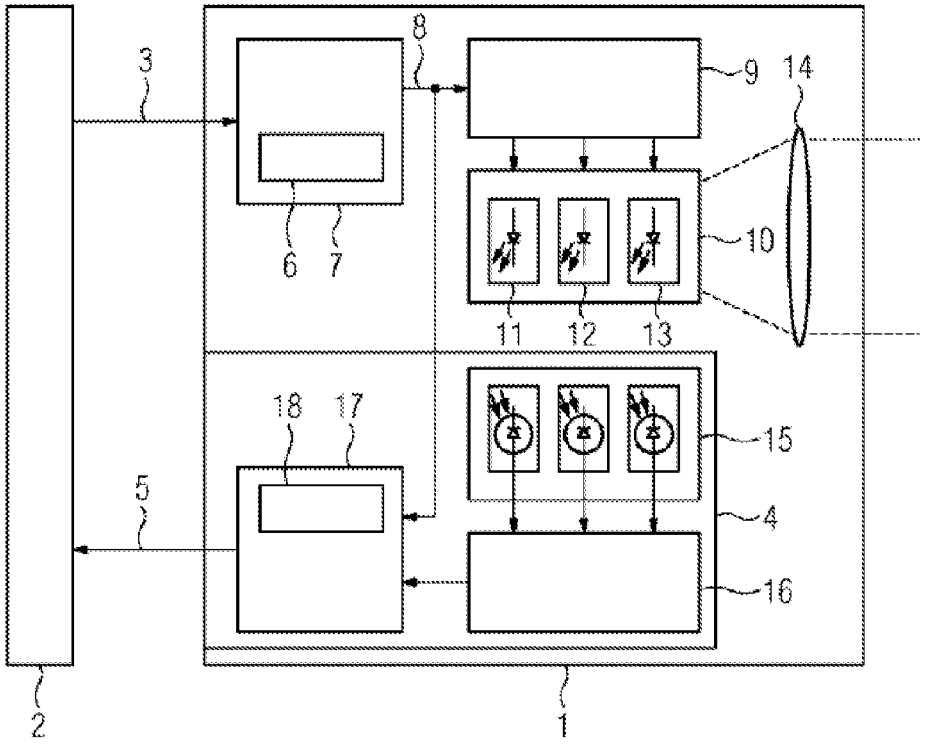
FIG. 1 shows important subassemblies of an LED light signal according to the invention.

An LED railway light signal substantially comprises a signal generator 1, which is activated 3 by a signal box 2 and has components for emitting light and a monitoring device 4, which is connected via feedback 5 to the signal box 2.

The requirement on the signal generator 1, transmitted from the signal box 2 to an activation device 7 equipped with a temperature sensor 6, includes information about the required signal pattern of the signal generator 1, in particular with regard to color and light intensity. In the activation device 7, the requirement message is linked with the output signal from the temperature sensor 6 in order to generate an intended signal 8, which is converted via an LED driver 9 into three activation signals for at least one RGB LED 10, the RGB LED 10 having individual LEDs 11, 12 and 13 in the colors red, yellow and blue.

The color of the light emitted via an optical system 14 is defined by the relative ratio of the three activation signals for the colors red, yellow and blue. This can be carried out, for example, via pulse width modulation with appropriate mark/space relationships in conjunction with a variation in the respective LED current. The light intensity is given by the sum of the activation signals.

The monitoring device 4 substantially comprises an optical sensor 15, a sensor amplifier 16 and an evaluation device 17. The optical sensor 15 measures the light from the RGB LED 10, while the sensor amplifier 16 is used to amplify and calibrate the sensor valves. By means of calibration, physical characteristics of the sensors, for example spectral sensitivity, are compensated.

The evaluation device 17 uses the signals from the sensor amplifier 16 to determine the color and light intensity of the emitted light. By means of linking or synchronization with the intended signal 8 generated by the activation device 7, the reliability and the availability of the monitoring can be increased. The evaluation device 17, just like the activation device 7, is provided with a temperature sensor 18, so that the feedback 5 of the state of the signal generator 1 to the signal box 2 can be provided while taking the ambient temperature into account. Also possible is an intrinsically safe reaction of the signal generator 1, for example switching off, which can be contained in the feedback 5.

Figure 2:
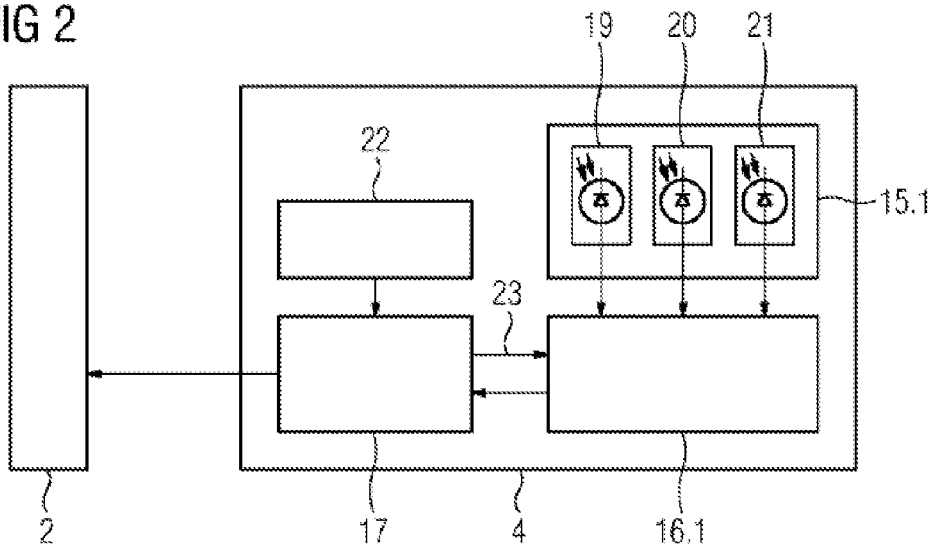
FIG. 2 shows a first embodiment of a monitoring device according to FIG. 1.

FIG. 2 shows an embodiment of the monitoring device 4 with an optical sensor 15.1, which includes color-specific, i.e. spectrally narrow-band, individual sensors 19 for red, 20 for yellow and 21 for blue. The three output signals from this multicolor sensor 15.1 are compensated in a three-channel sensor amplifier 16.1 in such a way that direct conclusions about the respective color components of the three channels are possible from the signals from the multicolor sensor 15.1. The compensation values follow from the characteristics of the multicolor sensor 15.1 and are preferably stored in a controller of the evaluation device 17. If the evaluation device 17 is connected to environmental sensors 22, for example temperature sensors 18, the compensation signal 23 can additionally take into account the response of the multicolor sensor 15.1 that depends on ambient conditions.

Figure 3:
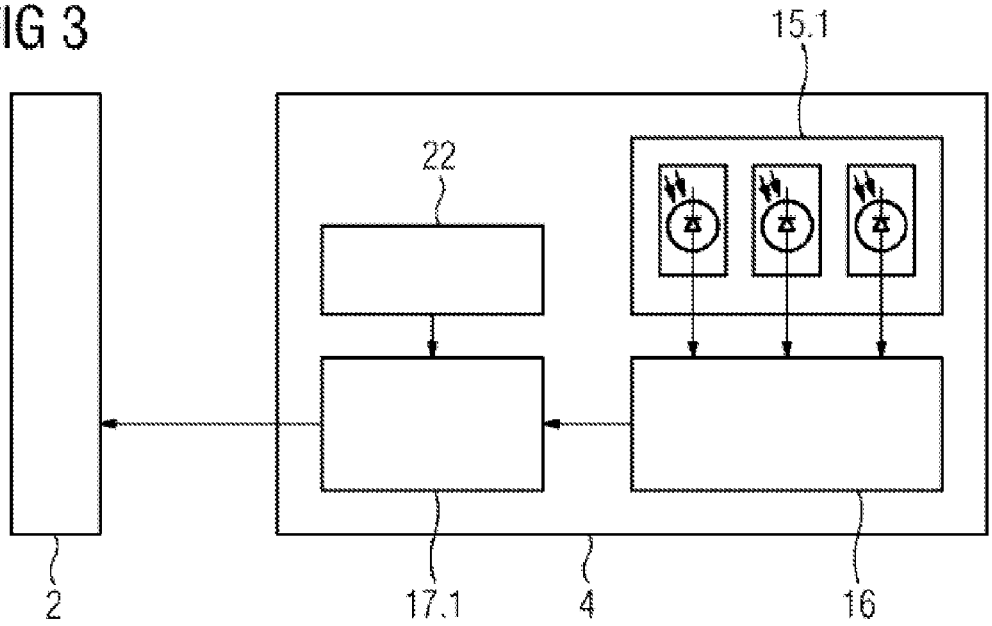
FIG. 3 shows a second embodiment of a monitoring device according to FIGS. 1.

FIG. 3 shows a variant of the monitoring device 4 according to FIG. 2, in which the sensitivity compensation takes place in the evaluation device 17.1 instead of in the sensor amplifier 16.1. The structure of the sensor amplifier 16 can be simplified as a result, while, because of higher dynamics of the input values of the evaluation device 17.1, the demands on the A/D converter upstream thereof are raised, however.

Figure 4:
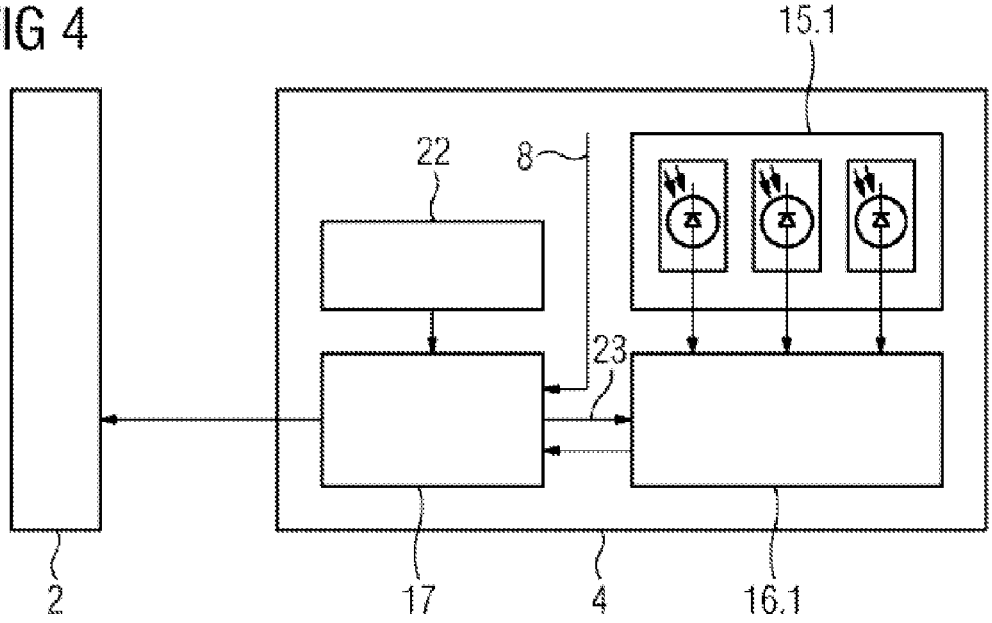
FIG. 4 shows a third embodiment of a monitoring device according to FIG. 1.

FIG. 4 illustrates a further variant for a monitoring device 4 according to FIG. 1. In addition to the embodiment according to FIG. 2, linking of the measured signal with the intended signal 8 branched off from the activation device 7 is carried out here. As a result, calculation of the signal to be expected from the optical multicolor sensor 15.1 is possible in the evaluation device 17. The factors for the calculation result from the spectral sensitivities of the multicolor sensor 15.1, i.e. from sensor-specific characteristics and the switching state of the signal generator 1 derived from the intended signal 8. In this way, the conversion of the sensor signal into color information can be omitted.

Figure 5:
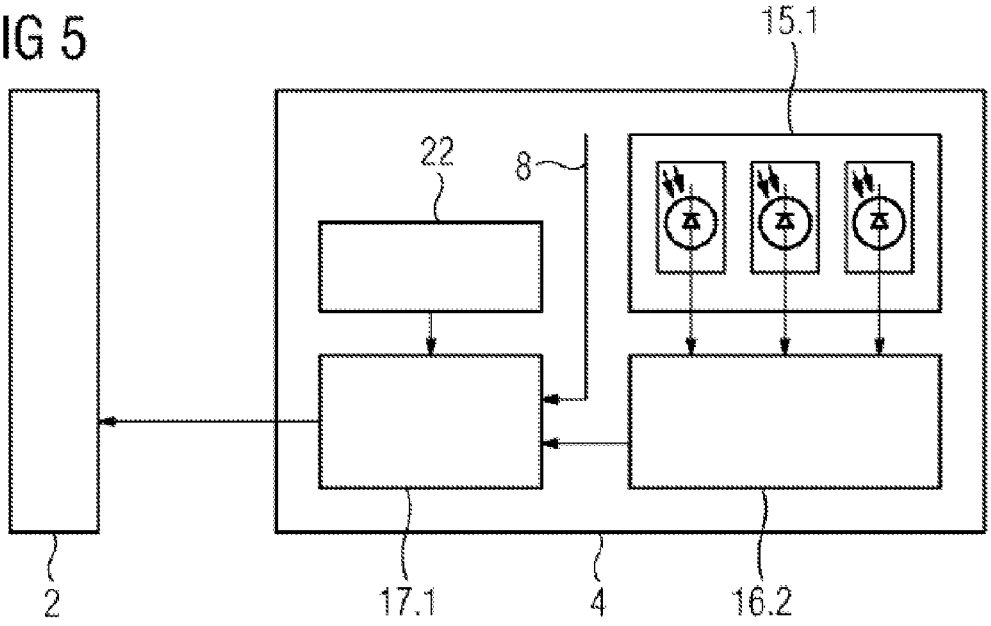
FIG. 5 shows a fourth embodiment of a monitoring device according to FIG. 1.

This monitoring variant with intended/actual comparison is illustrated in FIG. 4 for a sensor amplifier/evaluation device subassembly 16.1/17 according to FIG. 2, and in FIG. 5 for a sensor amplifier/evaluation device subassembly 16/17.1 according to FIG. 3.

Figure 6:
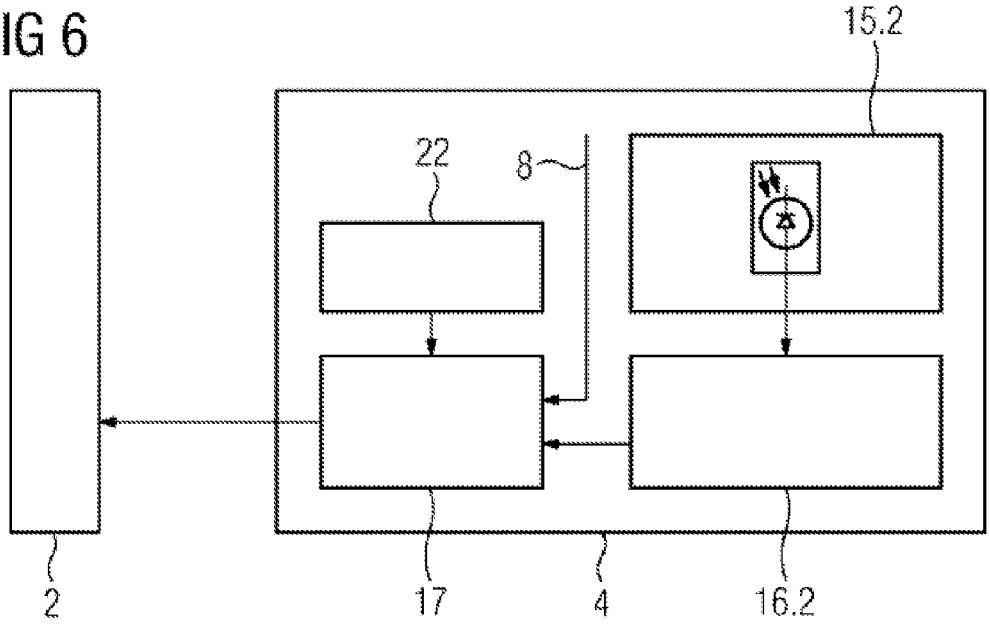
FIG. 6 shows a fifth embodiment of a monitoring device according to FIG. 1.

In the embodiment of the monitoring device 4 illustrated in FIG. 6, instead of the multicolor sensor 15.1, a wide-spectrum sensor 15.2 is provided. This generates an output signal which is fed to a single-channel sensor amplifier 16.2. As in the embodiments of FIGS. 4 and 5, the evaluation device 17 uses the intended signal 8 and the spectral sensitivity of the wide-spectrum sensor 15.2 to calculate an expected sensor signal. This expected signal is compared with the signal measured by the wide-spectrum sensor 15.2. A deviation between intended and actual signals is evaluated in a voter 24 and fed back to the signal box 2 in the feedback 5.

Figure 7:
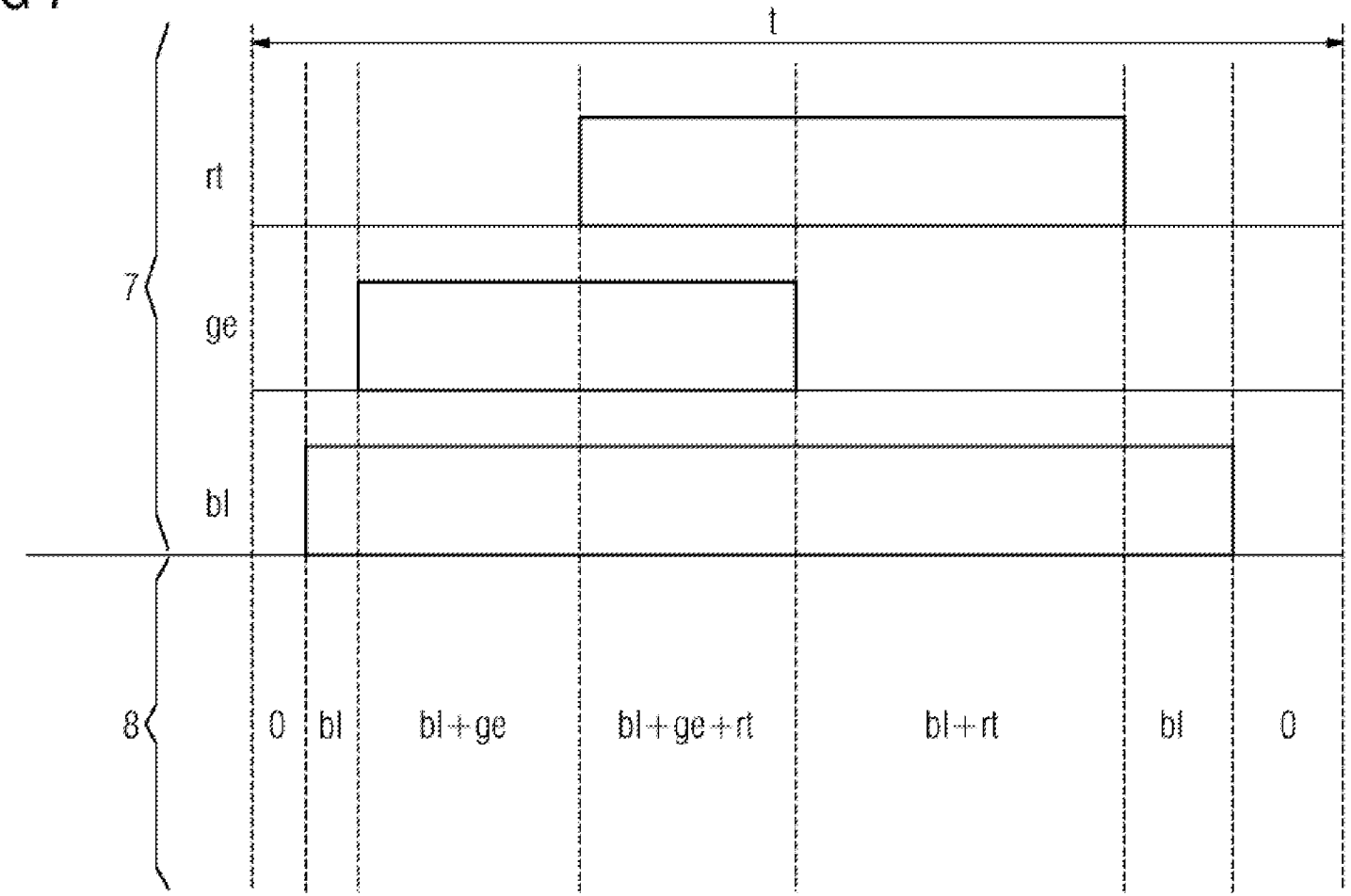
FIG. 7 shows a calculation schematic with regard to the intended sensor signal for a monitoring device according to FIG. 6.

FIG. 7 shows the principle for the calculation of the intended signal 8 for the wide-spectrum sensor 15.2. For the colors red rt, yellow ge and blue bl, the activation device 7 generates PWM signals with different lengths of bright and dark phases within a constant period t. The period t lies below the perception threshold. By means of highly time-resolved sampling of the measured sensor signal in combination with synchronized measurement of the intended signal 8, a failed or weakened color or LED can be detected. In the example according to FIG. 7, during the monitoring, the mixed colors displayed for red rt, yellow ge and blue bl must likewise result as the sum of the respective bright phases of the individual colors within the period t.

The invention claimed is:

1. An LED light signal, comprising:

a signal generator for generating variously colored light spots, said signal generator having LEDs embodied as multicolor LEDs, said signal generator having at least one optical sensor for monitoring a color locus and a light intensity reliably in terms of signaling technology;

a sensor amplifier;

an A/D converter;

a signal box;

a digital evaluation device, said optical sensor connected via said sensor amplifier and said A/D converter to said digital evaluation device for determining the color locus and the light intensity, said digital evaluation device generating a feedback signal dependent on environmental conditions, including an ambient temperature, and forwarding the feedback signal to said signal box, said signal box generating an activation signal to be applied to said signal generator; and means for comparing the feedback signal with the activation signal.

2. The LED light signal according to claim 1, wherein said optical sensor has a plurality of color-specific individual sensors.

3. The LED light signal according to claim 1, wherein said optical sensor is a wide-spectrum sensor.

4. The LED light signal according to claim 1, wherein said evaluation device has means for comparing at least one of the color locus or the light intensity with at least one of an intended color locus or an intended light intensity, wherein deviations which exceed a threshold value trigger an inherently safe reaction.

5. The LED light signal according to claim 1, wherein the LED light signal is an LED railway light signal.

6. The LED light signal according to claim 1, wherein said multicolor LEDs are RGB LEDs having red, yellow and blue LEDs.

* * * * *